US010294779B2

(12) United States Patent
Kyle et al.

(10) Patent No.: US 10,294,779 B2
(45) Date of Patent: May 21, 2019

(54) PASSIVE ATTENUATION OF NOISE FOR ACOUSTIC TELEMETRY

(71) Applicant: Halliburton Energy Services, Inc., Houston, TX (US)

(72) Inventors: Donald Kyle, The Colony, TX (US); Michael Linley Fripp, Carrollton, TX (US); Neal Gregory Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/112,388

(22) PCT Filed: Feb. 4, 2014

(86) PCT No.: PCT/US2014/014659
§ 371 (c)(1),
(2) Date: Jul. 18, 2016

(87) PCT Pub. No.: WO2015/119595
PCT Pub. Date: Aug. 13, 2015

(65) Prior Publication Data

US 2016/0333688 A1 Nov. 17, 2016

(51) Int. Cl.
*E21B 47/16* (2006.01)

(52) U.S. Cl.
CPC ..... *E21B 47/16* (2013.01)

(58) Field of Classification Search
None
See application file for complete search history.

(56) References Cited

U.S. PATENT DOCUMENTS

| | | | | |
|---|---|---|---|---|
| 6,354,146 | B1 * | 3/2002 | Birchak | E21B 47/101 73/61.79 |
| 6,837,332 | B1 * | 1/2005 | Rodney | G01V 1/48 181/0.5 |
| 7,210,555 | B2 | 5/2007 | Shah et al. | |
| 7,367,392 | B2 | 5/2008 | Duong et al. | |
| 8,210,046 | B2 * | 7/2012 | Luo | C08K 7/04 310/326 |
| 2007/0188344 | A1 | 8/2007 | Hache et al. | |

(Continued)

OTHER PUBLICATIONS

"DynaLink® Telemetry System, Reliable, real-time, wireless downhole communication," H07823, Halliburton, Testing & Subsea, Jul. 2011, 6 pages. http://www.halliburton.com/public/ts/contents/Brochures/web/TSS_DynaLink.pdf.

(Continued)

*Primary Examiner* — Leon Viet Q Nguyen
(74) *Attorney, Agent, or Firm* — John W. Wustenberg; Parker Justiss, P.C.

(57) ABSTRACT

An acoustic well telemetry system has an acoustic telemetry transducer affixed to an in-well type component and a damper between the transducer and the in-well type component. The damper damps transmission from the in-well type component to the transducer of a specified frequency range. A method includes damping a specified frequency range from transmission from an in-well type component to an acoustic telemetry transducer in a well, and receiving another frequency range outside of the specified frequency range with the transducer.

18 Claims, 3 Drawing Sheets

(56) References Cited

U.S. PATENT DOCUMENTS

| | | | | |
|---|---|---|---|---|
| 2008/0197306 | A1* | 8/2008 | Judge | E21B 33/062 251/1.3 |
| 2010/0201540 | A1 | 8/2010 | Li et al. | |
| 2010/0268489 | A1* | 10/2010 | Lie | E21B 47/101 702/51 |
| 2011/0011576 | A1 | 1/2011 | Cavender et al. | |
| 2014/0000371 | A1* | 1/2014 | Engl | G01N 29/2437 73/640 |
| 2014/0262656 | A1* | 9/2014 | Song | E21B 17/01 188/378 |
| 2015/0023137 | A1* | 1/2015 | Benson | E21B 7/06 367/82 |

OTHER PUBLICATIONS

PCT International Search Report and Written Opinion of the International Searching Authority, PCT/US2014/014659, dated Nov. 6, 2014, 15 pages.

* cited by examiner

PASSIVE ATTENUATION OF NOISE FOR ACOUSTIC TELEMETRY

CROSS-REFERENCE TO RELATED APPLICATIONS

This application is a U.S. National Phase Application under 35 U.S.C. § 371 and claims the benefit of priority to International Application Serial No. PCT/US2014/014659, filed on Feb. 4, 2014, the contents of which are hereby incorporated by reference.

BACKGROUND

The present disclosure relates to acoustic telemetry systems for communications in subterranean well systems.

Downhole acoustic telemetry systems have difficulty decoding acoustic communication signals when there is a high ambient noise level. There is a need to cancel out noise to improve the signal to noise ratio, so that the communication signals can be decoded. The well tool lengths are small compared to the wavelength of the acoustic communication signal, making spatial noise cancellation impractical. Electronic filtering is standard practice, but high noise swamps electronics.

DESCRIPTION OF DRAWINGS

Like reference symbols in the various drawings indicate like elements.

DETAILED DESCRIPTION

Figure 1:
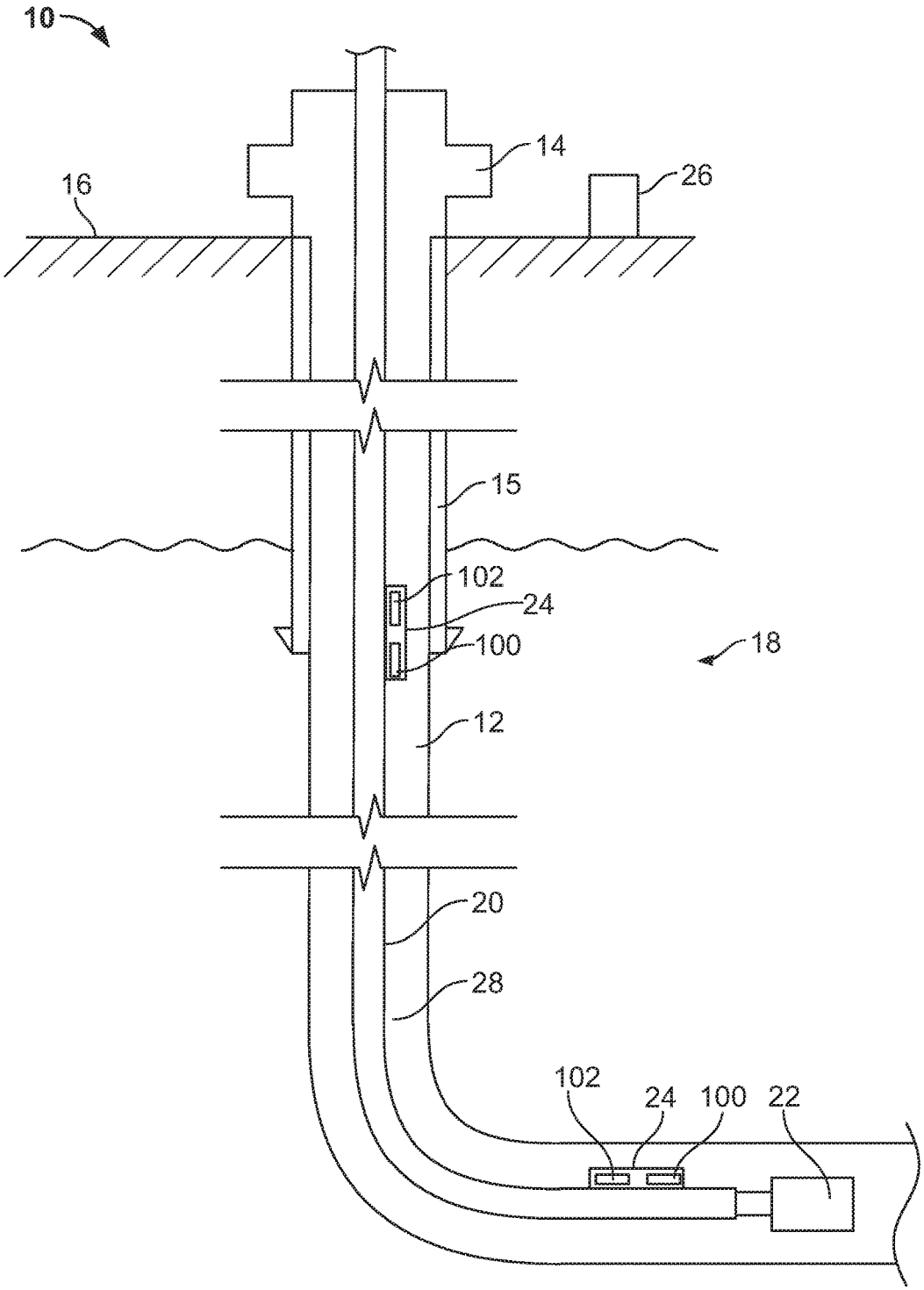
FIG. 1 is a schematic partially cross-sectional view of a well system with a well telemetry system.

FIG. 1 depicts an example well system 10 that includes a substantially cylindrical wellbore 12 extending from a wellhead 14 at the terranean surface 16 downward into the Earth into one or more subterranean zones of interest 18 (one shown). A portion of the wellbore 12 extending from the wellhead 14 to the subterranean zone 18 is lined with lengths of tubing, called casing 15. A well string 20 is shown as having been lowered from the surface 16 into the wellbore 12. The well string 20 is a series of jointed lengths of tubing coupled together end-to-end and/or a continuous (i.e., not jointed) coiled tubing, and includes one or more well tools 22 (one shown, but more could be provided). FIG. 1 shows the well string 20 extending to the surface 16. In other instances, the well string 20 can be arranged such that it does not extend to the surface 16, but rather descends into the well on a wire, such as a slickline, wireline, e-line and/or other wire. The well string 20 is shown as also having multiple downhole telemetry elements 24 for sending and receiving telemetric communication signals encoded as acoustic vibrations carried on the well string 20 as vibrations in the materials of its components. One of the downhole telemetry elements 24 is associated with the well tool 22 to encode communications from the well tool 22 and decode communications to the well tool 22. Additional telemetry elements 24 can be provided to communication with other well tools, sensors and/or other components in the wellbore 12. The downhole telemetry elements 24 communicate with each other and with a surface telemetry station 26 outside of the wellbore 12. Although shown on the well string 20, the telemetry elements 24 can additionally or alternatively be provided on other components in the well, including the casing 15.

Figure 2:
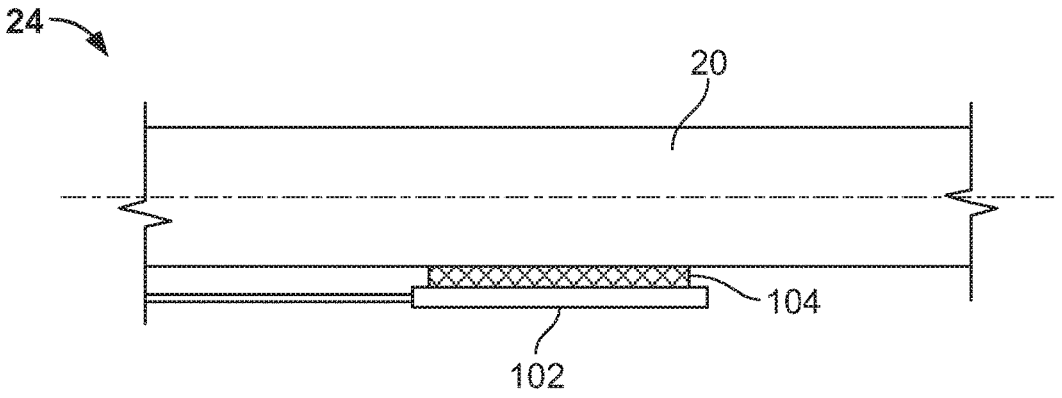
FIG. 2 is a schematic cross-sectional side view of an example telemetry element that can be used in the well telemetry system of FIG. 1.

Each of the downhole telemetry elements 24 includes a controller 100 for encoding/decoding communications for transmission as acoustic vibrations and a transducer 102. FIG. 2 is a detail cross-sectional view of a transducer 102 of a downhole telemetry element 24 mounted on a well string 20 with a damper 104 between the well string 20 and the acoustic transducer 102. The transducer 102 translates acoustic communication signals into electrical signals and electrical signals into acoustic communication signals transmitted. The damper 104 damps transmission of a specified acoustic mode, such as a frequency range or vibrational mode, from the well string 20 to the transducer 102. The acoustic communication signals are in a specified frequency range and/or specified vibrational mode. However, vibration from operation of the well string 20 and other sources of acoustic vibration transmitted through the well string 20 are noise to the acoustic communication signals. Therefore, in certain instances of a telemetry element having a single transducer 102, the damper 104 is configured to damp a specified frequency range outside of the frequency range of the communication signals to reduce the noise received by the transducer 102. In certain instances, the damper 104 is configured to damp a specified frequency range that corresponds with the most prominent noise frequency range. In certain instances, the damper 104 damps transmission of a specified mode of acoustic vibration. For example, the damper could preferentially dampen the flexural modes of acoustic vibration or the torsional modes of acoustic vibration while having minimal effect on the axial modes of acoustic vibration. While these acoustic vibration modes may be at the same frequency, their mode of vibration is different. The acoustic communication would be in one mode of vibration (such as the axial vibration modes) while the noise would be in a different mode of vibration (such as the flexural vibration modes). In either example, the resulting signal received by the transducer 102, thus, has a higher signal to noise ratio and the transducer 102 outputs an electric signal with a higher signal to noise ratio. In certain instances, additional electrical filtering can be applied by the controller 100 and/or surface station 26. The noise could also be the product of a second acoustic transmitter. The damper would be configured to minimize the signal from the second acoustic transmitter in favor of listening to a third acoustic transmitter. In all of these examples, the noise reflects an undesired acoustic signal.

Figure 3:
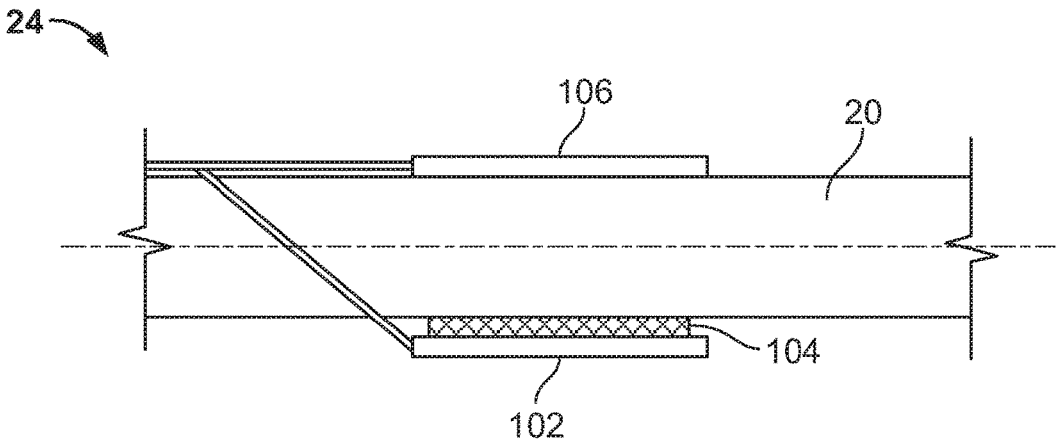
FIG. 3 is a schematic cross-sectional side view of example telemetry elements that can be used in the well telemetry system of FIG. 1.

Referring to FIG. 3, a cross-sectional view of another configuration of an example telemetry element 24 on a well string 20 is shown. The telemetry element 24 has the acoustic telemetry transducer 102 and damper 104 like FIG. 2, and also a second acoustic telemetry transducer 106 that is more rigidly fixed to the well string 20 than the first mentioned transducer 102. In certain instances, the second transducer 106 is affixed to the well string 20 with a highly acoustically transmissive adhesive. The example telemetry element 24 of FIG. 3 receives a damped acoustic signal from the well string 20 to the first mentioned transducer 102 and an undamped acoustic signal from the well string 20 to the second transducer 106, and sends corresponding electrical signals to a destination, for example, the controller 100 and/or the surface station 26. The controller 100 and/or surface station 26 distinguishes communication from noise based on the signal received from the first mentioned transducer 102 and the signal received from the second transducer 106. In some instances, the damper 104 is configured to damp a specified acoustic mode in or corresponding to the acoustic mode of the communication signals. Thus, the controller 100 and/or surface station 26 distinguishes communication from noise by subtracting the signal received from the first mentioned transducer 102 (i.e., substantially noise) from the signal received from the second transducer 106 (i.e., both noise and communication signal). As a result, subtracting the signal received from the transducer 102 from the signal received from the second transducer 106 results in a communication signal substantially without noise and a higher signal to noise ratio than without the damping. In certain instances, additional electronic filtration of the resulting signal can be performed by the controller 100 and/or the surface station 26 to further reduce noise.

Figure 4:
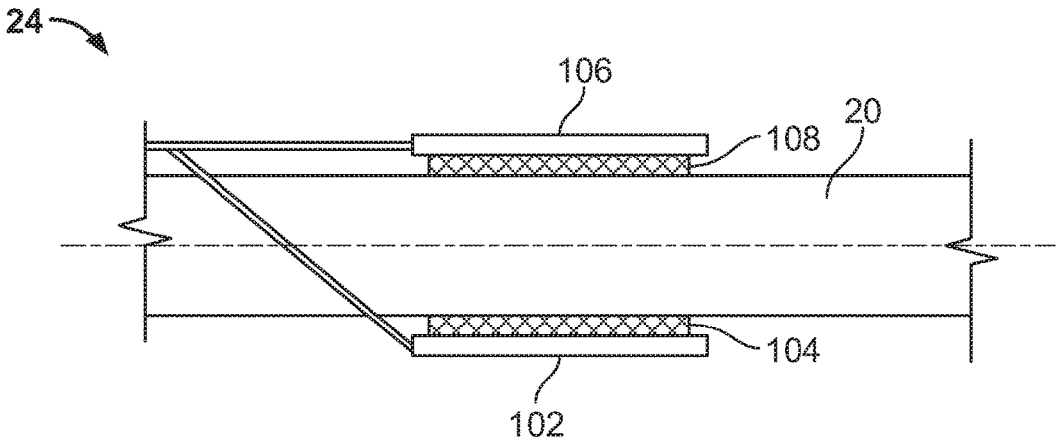
FIG. 4 is a schematic cross-sectional side view of example telemetry elements that can be used in the well telemetry system of FIG. 1.

Referring to FIG. 4, a cross-sectional view of another configuration of the example telemetry element 24 on the well string 20 is shown. The telemetry element 24 has the transducer 102, the damper 104, and the second transducer 106 like FIG. 3, and also a second damper 108 between the second transducer 106 and the well string 20. The second damper 108 damps transmission from the well string 20 to the second transducer 106 in a second specified acoustic mode that is different than the first mentioned specified acoustic mode of the damper 104. In other instances, the first mentioned specified acoustic mode of the damper 104 is the same as the second specified acoustic mode, providing redundancy in the signal.

In some implementations, the damper 104, 108 is one or more layers of material, such as a silicone, epoxy, elastomer, polytetrafloroethylene (PTFE), hydrogenated nitrile butadine rubber (HNBR), composite such as glass, arimid or carbon (including composite with uniaxial fibers), foam (including open cell foam), cross-linked gel, low stiffness metal, aerogel, and/or other material. Each layer can be a single material or a combination of materials, and different layers can have a different composition. In certain instances, the damper 104, 108 can be made up of multiple layers of hard and soft elements that can produce an impedance mismatch, tuned by the layers to produce a modal filter. In one example, the layers can include layers of metal bonded together with layers of epoxy. Additionally, or alternatively, the damper 104, 108 is a mechanical component, such as an O-ring, mechanical spring, shock, and/or other damping element. In certain instances, the damper 104 is a shear stiffening material that becomes stiff at certain shear rates, i.e., in response to certain frequencies. An example shear stiffening material is silica nanoparticles in polyethylene glycol, dilatant materials and rheopectic materials, such as 3179 dilatant compound (a product of Dow Corning Corporation), gypsum paste, and carbon black suspensions. In some instance, rubber becomes stiffer at higher shear rates. Other examples exist and are within the concepts herein.

Figure 5A:
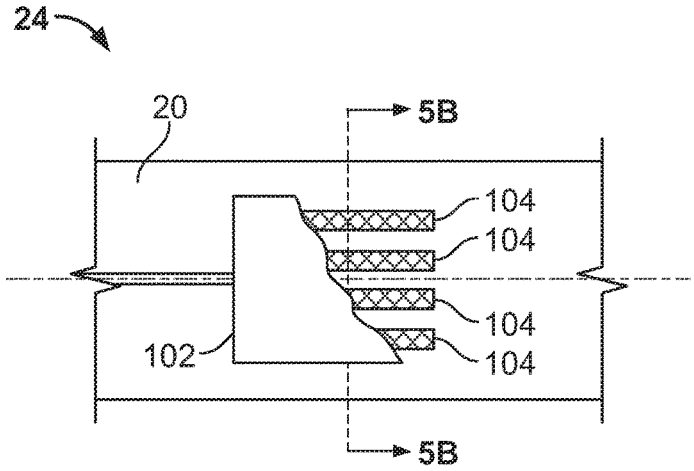
FIGS. 5A and 5B are a schematic cut-away top view (FIG. 5A) and a cross-sectional end view (FIG. 5B) of an example telemetry element that can be used in the well telemetry system of FIG. 1.
Figure 5B:
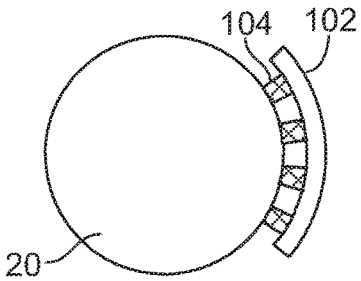

In some instances, the damper 104, 108 is continuous, covering all the space between the transducer and the well string. In other instances, the damper is non-continuous, with gaps between the transducer and the well string. In other instances, the damper is non-continuous, with non-damping material between the transducer and the well string. The shape of the damper 104, 108 and any gaps can be used to tune the directionality of the damper to be more transmissive of acoustic signals in one direction than another. Referring to FIGS. 5A and 5B, an implementation of the transducer 102 and damper 104 is shown in a side view with a cross-sectional view in section 5B-5B, respectively. In this example, the damper 104 affixes to the transducer 102 in spaced apart parallel lines. The same configuration can also be implemented on the second transducer 106 and the second damper 108. In other instances, the lines can be of different size, number, and location. Alternatively or in addition to lines, the damper can be arranged as one or more dots, rings, ellipses, and/or other shapes.

Figure 6:
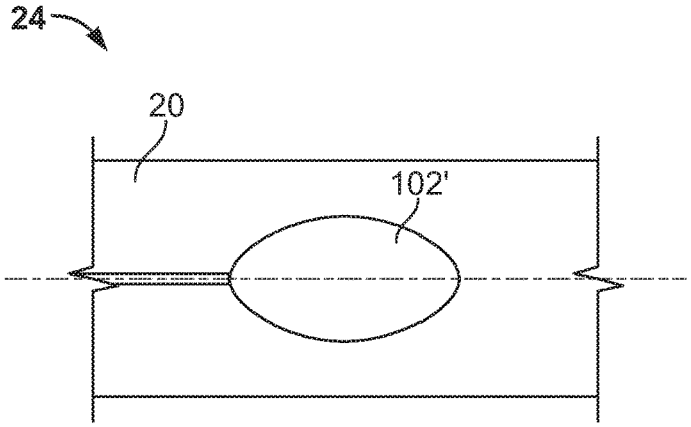
FIG. 6 is a schematic top view an example telemetry element that can be used in the well telemetry system of FIG. 1.

In certain instances, the length and shape of the second transducer 106 is the same as that of the transducer 102. In other instances, they can be different lengths and/or shapes. In some instances, one or both of the transducers 102, 106 is shaped and sized based on the specified frequency range of the communication signal. For example, referring to FIG. 6, the shape of an example transducer 102' is tuned, with a wider middle portion than end portions, to have a greater sensitivity to the frequency range of the communication signal than to other frequencies. Thus, the shape can make the transducer 102' less sensitive to frequencies associated with noise. In other instances, the transducer can be shaped to make the transducer less sensitive to other frequencies. The transducers can be shaped and sized to more or less sensitive to certain frequencies based on the characteristics of the damper used with the transducer or with the other transducer, and in certain instances, a transducer shaped to be more or less sensitive to certain frequencies can be used without a damper.

In certain instances, the transducer with the damper is used in transmitting an acoustics communication signal. Using the damped transducer allows for less sophisticated transmitter electronics. For example, the transmitter electronics can be a bang-bang type transmitter that generates broadband, impulsive signals and the damper can damp the output from the transducer to contain or limit the frequency range of the transmission. Containing the frequency band of the transmission can reduce echoes.

In view of the above, certain aspects encompass an acoustic well telemetry system. The system includes an acoustic telemetry transducer affixed to an in-well type component, and a damper between the transducer and the in-well type component. The damper damps transmission from the in-well type component to the transducer of a specified frequency range or vibrational mode.

Certain aspects encompass a method where a specified frequency range or vibrational mode of transmission from an in-well type component to an acoustic telemetry transducer in a well is damped. Another frequency range or vibrational mode outside of the specified frequency range is received with the transducer.

Certain aspects encompass, an acoustic well telemetry system that includes an acoustic telemetry transducer affixed to an in-well type component, a damper between the transducer and the in-well type component, and a receiving station communicably coupled to the transducer to receive signal from the transducer. The damper damps transmission from the in-well type component to the transducer of a specified frequency range or vibrational mode.

Implementations can include some, none, or all of the following features. The specified frequency range of the damper is noise to communications of the telemetry system. The damper includes a shear stiffening material. The damper includes a material that damps frequencies in the specified range. The damper is directionally preferential to damp transmission of acoustic energy greater in a first direction than a second, different direction. The damper includes a damper material affixed to the transducer in parallel lines. The acoustic telemetry system includes a second acoustic telemetry transducer more rigidly affixed to the in-well type component than the first mentioned transducer. The acoustic telemetry system includes a receiving station communicably coupled to the first mentioned transducer and the second transducer that distinguishes communication from noise based on a signal received from the first mentioned transducer and a signal received from the second transducer. The specified acoustic mode of the damper is the communication acoustic mode of the telemetry system. The receiving station distinguishes communication from noise by subtracting the signal received from the first mentioned transducer from the signal received from the second transducer. The acoustic telemetry system includes a second damper between the second transducer and the in-well component to damp transmission from the in-well type component to the second transducer in a second specified frequency that is different than the first mentioned acoustic mode. The transducer is shaped to respond more efficiently to frequencies outside of the specified frequency range. The transducer is wider in a middle portion than an end portion. The receiving station identifies signal from the transducer as noise to communications of the telemetry system. The other acoustic mode includes a communication, and damping a specified acoustic mode includes damping noise to the communication. Damping a specified acoustic mode and receiving another acoustic mode includes receiving the specified acoustic mode and the other acoustic mode with a second acoustic telemetry transducer in the well and distinguishing noise from communication based on a signal of the first mentioned transducer and a signal of the second transducer. The specified acoustic mode is a communication acoustic mode of the telemetry system. Distinguishing noise from communication includes subtracting a signal of the first mentioned transducer from a signal of the second transducer. Damping a specified acoustic mode and receiving another acoustic mode includes using a bang-bang controller that minimizes the frequency band of a transmission to minimize echoes in the filtered acoustic signal.

A number of embodiments have been described. Nevertheless, it will be understood that various modifications may be. Accordingly, other embodiments are within the scope of the following claims.

What is claimed is:

1. An acoustic well telemetry system, comprising:

a first acoustic telemetry transducer affixed to an exterior surface of an in-well type component;

a first damper between the first acoustic telemetry transducer and the exterior surface of the in-well type component to damp transmission from the in-well type component to the first acoustic telemetry transducer of a specified acoustic mode in a first specified frequency, where the specified acoustic mode of the first damper is a communication frequency range of the telemetry system;

a second acoustic telemetry transducer;

a second damper between the second acoustic telemetry transducer and the in-well component to damp transmission from the in-well type component to the second acoustic telemetry transducer in a second specified frequency; and a receiving station communicably coupled to the first acoustic telemetry transducer and the second acoustic telemetry transducer.

2. The acoustic telemetry system of claim 1, where the specified acoustic mode of the first damper or the second damper is noise to communications of the telemetry system.

3. The acoustic telemetry system of claim 1, where the first damper or the second damper comprises a shear stiffening material.

4. The acoustic telemetry system of claim 1, where the first damper or the second damper comprises a material that damps a specified frequency range.

5. The acoustic telemetry system of claim 1, where the first damper or the second damper is directionally preferential to damp transmission of acoustic energy greater in a first direction than a second, different direction.

6. The acoustic telemetry system of claim 1, where the first damper or the second damper comprises a damper material affixed to the transducer in parallel lines.

7. The acoustic telemetry system of claim 1, wherein the receiving station distinguishes communication from noise based on a signal received from the first acoustic telemetry transducer and a signal received from the second acoustic telemetry transducer.

8. The acoustic telemetry system of claim 7, where the receiving station distinguishes communication from noise by subtracting the signal received from the first acoustic telemetry transducer from the signal received from the second acoustic telemetry transducer.

9. The acoustic telemetry system of claim 8, wherein the second specified frequency is different than the first mentioned specified frequency.

10. The acoustic telemetry system of claim 1, where the first acoustic telemetry transducer or the second acoustic telemetry transducer is shaped to respond more efficiently to frequencies outside of a specified frequency range.

11. The acoustic telemetry system of claim 10, where the first acoustic telemetry transducer or the second telemetry transducer is of varying width.

12. A method, comprising:

damping a specified acoustic mode in a first specified frequency from transmission from an in-well type component to a first acoustic telemetry transducer in a well, where the specified acoustic mode is a communication frequency range of a telemetry system;

damping another acoustic mode outside of the specified acoustic mode in a second specified frequency with a second acoustic telemetry transducer in the well; and distinguishing noise from communication based on a signal of the first acoustic telemetry transducer and a signal of the second acoustic transducer by subtracting the signal of the first acoustic telemetry transducer from the signal of the second acoustic telemetry transducer.

13. The method of claim 12, where the other acoustic mode comprises a communication, and damping a specified acoustic mode comprises damping noise to the communication.

14. An acoustic well telemetry system, comprising:

a first acoustic telemetry transducer affixed to an exterior surface of an in-well type component;

a first damper between the first acoustic telemetry transducer and the exterior surface of the in-well type component to damp transmission from the in-well type component to the first acoustic telemetry transducer of a specified acoustic mode in a first specified frequency, where the specified acoustic mode of the first damper is a communication frequency range of the telemetry system;

a second acoustic telemetry transducer;

a second damper between the second acoustic telemetry transducer and the in-well type component to damp transmission from the second acoustic telemetry transducer in a second specified frequency; and a controller communicably coupled to the first acoustic telemetry transducer and the second acoustic telemetry transducer to receive a signal from the first acoustic telemetry transducer and a signal from the second acoustic telemetry transducer.

15. The acoustic telemetry system of claim 14, where the first damper or the second damper comprises a material that damps frequencies in a specified range.

16. The acoustic telemetry system of claim 15, where the specified frequency range is noise to communications of the telemetry system.

17. The acoustic telemetry system of claim 16, where the controller identifies communication from the first acoustic telemetry transducer or the second telemetry transducer as noise to communications of the telemetry system.

18. The acoustic telemetry system of claim 14, where the controller compares signals received from the first mentioned acoustic telemetry transducer and the second acoustic telemetry transducer to identify communication from noise.

* * * * *